United States Patent [19]

Hennessy

[11] 4,376,542

[45] Mar. 15, 1983

[54] HOPPER DOOR GASKET STRUCTURE

[75] Inventor: James J. Hennessy, Chambersburg, Pa.

[73] Assignee: Hennessy Products, Incorporated, Chambersburg, Pa.

[21] Appl. No.: 288,062

[22] Filed: Jul. 29, 1981

[51] Int. Cl.[3] ..... B61D 7/20

[52] U.S. Cl. ..... 277/189; 105/282 A; 105/247

[58] Field of Search ..... 49/493; 277/166, 189

[56] References Cited

U.S. PATENT DOCUMENTS

| | | | |
|---|---|---|---|
| 2,231,947 | 2/1941 | Rich | 277/189 |
| 3,596,611 | 8/1971 | Floehr | 105/282 A |
| 3,779,172 | 12/1973 | Schipper et al. | 105/282 A |
| 3,853,070 | 12/1974 | Hennessy | 105/247 |

*Primary Examiner*—Robert I. Smith

*Attorney, Agent, or Firm*—F. Travers Burgess

[57] ABSTRACT

A gasket structure for application to a hopper car door edge comprises an elongated flexible gasket of compressible material having a relatively thick body with a continuous tangentially projecting rib and a plurality of narrow elongated spring clips extending transversely of the gasket and each having a straight end portion underlying the gasket and riveted to the rib thereof, a straight intermediate portion angularly disposed with respect to the straight end portion, and an opposite end portion curved in the opposite direction with respect to the intermediate portion from the angulation of the straight end portion to form a nearly closed loop, the straight end portion being adapted to engage the inner surface of the hopper door web with the intermediate portion engaging the sloping peripheral rim of the hopper door and with the opposite end grippingly engaging the outer surface of the peripheral rim to secure the gasket against the door web.

6 Claims, 6 Drawing Figures

HOPPER DOOR GASKET STRUCTURE

BACKGROUND OF THE INVENTION

1. Field of the Invention:

The invention relates to gasket structures and consists particularly in a gasket structure for railway hopper car doors having improved means for attachment to the doors.

2. The Prior Art:

The present invention is an improvement over the gasket structure disclosed and claimed in my U.S. Pat. No. 3,853,070, in which the gasket was secured to a hopper door by a plurality of narrow elongated spring clips of Z contour extending transversely of the gasket and each having a return bend at one end adapted to receive and tightly grip the door edge and an oppositely facing return bend at its other end to grip the flange of the gasket to retain the gasket against the web of the door.

SUMMARY OF THE INVENTION

A general object of the invention is to provide an improved clip for railway hopper car door gaskets of simple, inexpensive construction yet easier to apply and more effective than prior art clips for securing gaskets to hopper car doors.

DETAILED DESCRIPTION OF THE INVENTION

Figure 1:
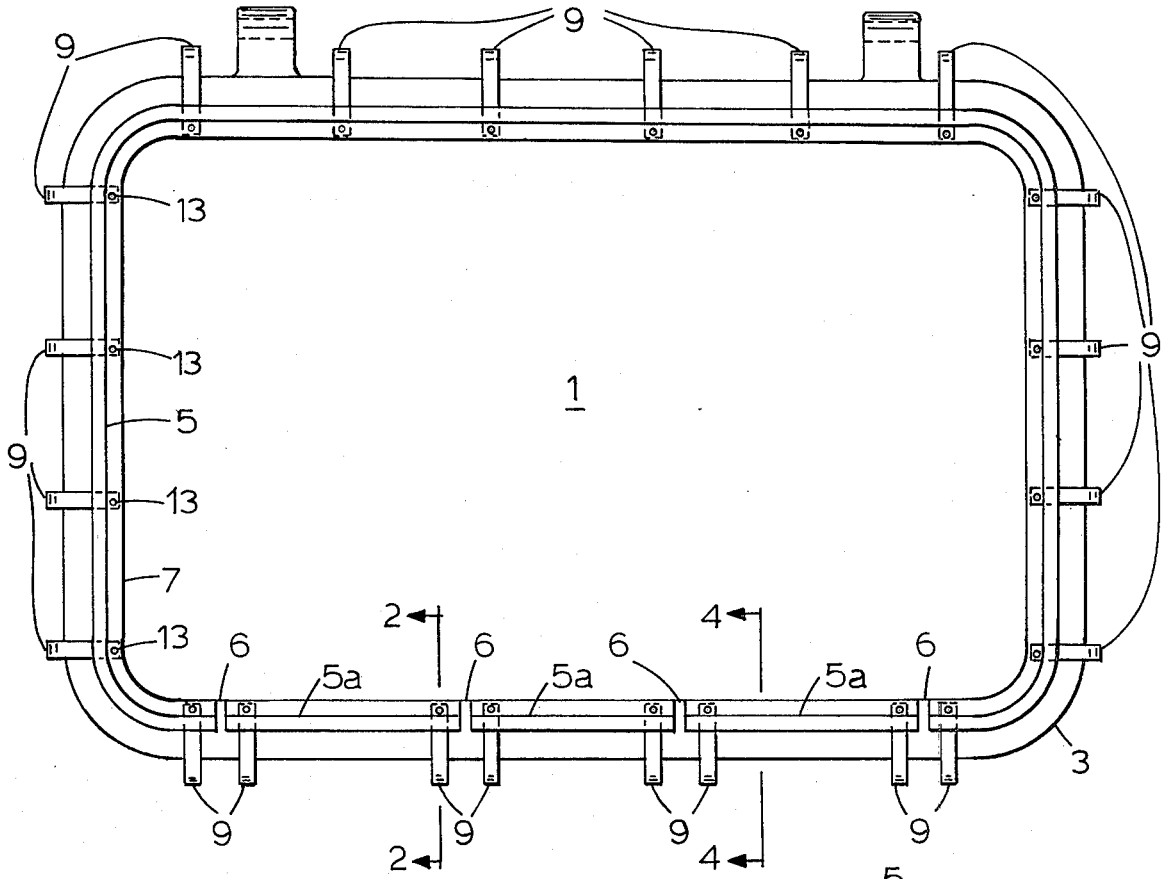
FIG. 1 is a plan view of a railway car hopper door equipped with a gasket structure embodying the invention.

The numeral 1 denotes a hopper door constructed of sheet or cast metal in the form of a flat bottomed pan having a generally upwardly and outwardly directed peripheral rim 3 with straight sides and ends and rounded corners. A flexible elongated gasket 5 is of compressible material having a thickened body preferably of tubular cross section with a rib 7 projecting tangentially from the bottom thereof. Gasket 5 is positioned along the intersection between the door web and peripheral rim 3 with its bottom tangential rib 7 abutting the top of the door web and is secured in this position by a plurality of clips generally indicated at 9 extending transversely of gasket 5, 7. Each of the clips 9 comprises a narrow elongated strip of thin metal spring material having a straight end portion 11 underlying gasket body 5 and rim 7 and secured by a rivet 13 to rib 7, the bottom of end portion 11 abutting the upper surface of door web 1. Clip 9 is angulated upwardly at 15 to form a straight intermediate portion 17 abuttingly engaging the inner surface of door peripheral rim 3 and the outer end portion is curved in the opposite direction from the angulation at 15 to form a relatively narrow nearly closed loop 19 elongated in the same general direction as clip intermediate portion 17. The extremity 21 of loop 19 is inturned and terminates in close proximity to the intermediate portion of the clip. The end of terminal portion 21 is formed with serrations 25 to effect tight gripping engagement with the outer surface of rim 3.

Figure 2:
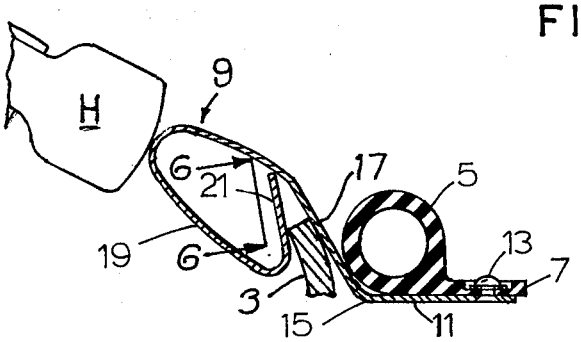
FIG. 2 is an enlarged transverse vertical sectional view of the gasket structure corresponding to a section along line 2—2 of FIG. 1, but prior to application to a door.
Figure 3:
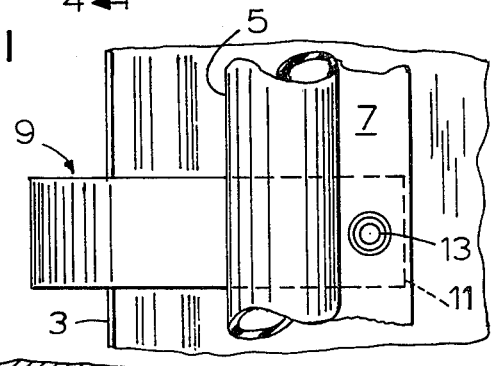
FIG. 3 is an enlarged fragmentary top view of the gasket structure including a retaining clip and adjacent portion of the door.
Figure 6:
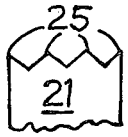
FIG. 6 is a fragmentary view taken from line 6—6 showing the door rim-engaging terminal portion of the retaining clip.

With this construction, the gasket structure may be applied to a door simply by placing the clip on the door rim with the outer margin of the door rim in the space between intermediate portion 17 and inturned terminal portion 21 of the clip and striking the narrow outer end of elongated loop 19 with hammer head H to force the clip downwardly along the door rim until straight end portion 11 and straight intermediate portion 17 are in engagement respectively with the web and rim of the door, at which time the outer margin of rim 3 will have spread the loop portion 19 sufficiently that serrations 25 on clip terminal 21 engage the outer surface of peripheral rim 3 at an acute angle, as best seen in FIG. 2, and thus resist any forces tending to separate the clip and the gasket strip from the door. The narrow elongated shape of the loop resists distortion of the loop from blows applied to its narrow outer end during application of the clip to a door and effectively transmits the force of the blows to clip intermediate portion 17 and terminal 21. To prevent the accumulation of water in the hopper, the gasket along the lower rim of the door may consist of short lengths **5*a* of the same gasket material separated from each other and from gasket 5 by small spaces 6**.

Figure 4:
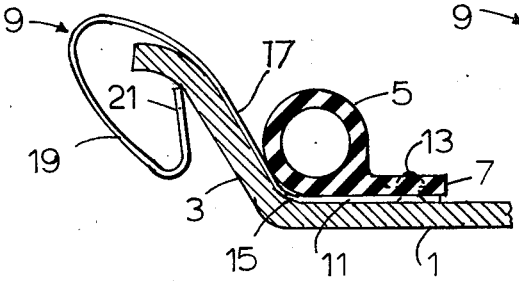
FIG. 4 is an enlarged transverse vertical sectional view taken along line 4—4 of FIG. 1, with the door open and the gasket uncompressed.
Figure 5:
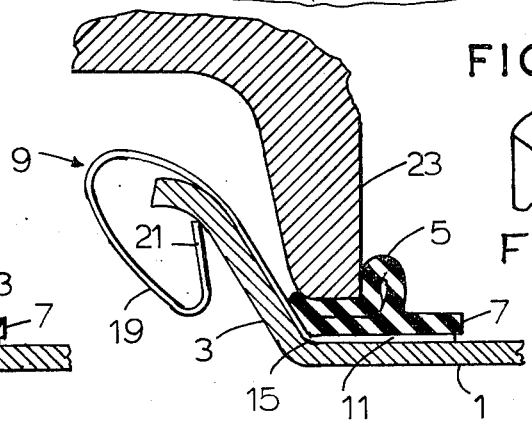
FIG. 5 is a transverse vertical sectional view corresponding to FIG. 4, but showing the door closed and the gasket compressed between the hopper frame and the door web.

Upon closure of door 1, flange 23 of the hopper frame compresses gasket 5, 7 to the configuration shown in FIG. 4 so that the compressed gasket effects a tight seal between the door and the hopper frame flange.

From the foregoing it will be evident that gasket structures made in accordance with the invention can easily be applied to hopper doors and when so applied will remain in place on the doors as long as may be required because of the permanent securement of the clips to the gasket strip by rivets 13 and the resistance of the clip to removal from the door.

The cross section of the gasket strip and the details of the shape of the attaching clips may be varied without departing from the spirit of the invention and the exclusive use of such modifications as come within the scope of the appended claims is contemplated.

I claim:

1. A gasket structure applicable to a hopper door edge and comprising an elongated flexible body of compressible material of substantial thickness with a tangentially projecting rib, and a plurality of relatively short narrow clips of thin metal spring material positioned transversely of said elongated flexible body and each comprising a straight end portion underlyingly abutting the body and rib of said gasket, said straight end portion incorporating means securing it directly to said rib, a straight intermediate portion angulated with respect to said straight end portion, and a second end portion curved in the opposite direction from the angulation of said straight intermediate portion with respect to said straight end portion to form a relatively narrow substantially closed loop elongated in the same general direction as said intermediate portion and having a straight terminal portion inturned to approach said intermediate portion at an acute angle to facilitate the reception therebetween of the rim of the door, said terminal portion terminating in a transverse edge for gripping engagement with the door rim, said transverse edge being serrated to enhance the gripping engagement of said clips to the door rim and resist shifting of said clips and the gasket structure peripherally of the door.

2. A gasket structure according to claim 1, wherein the angularity between said first end portion and said intermediate portion is substantially equal to the angularity between the web and the rim of the hopper door.

3. A gasket structure according to claim 2, wherein the first return bend in the curved end portion of said clip is spaced from the intersection of said first end portion and said intermediate portion a greater distance than the width of said rim and the intersection of said loop terminal and said curved portion is a shorter distance from the intersection between said first end portion and said intermediate portion than the thickness of said rim.

4. A gasket structure according to claim 1, wherein said securing means comprises a fastener passing through said straight end portion and said rib.

5. A gasket structure according to claim 4, wherein said fastener has a narrow intermediate portion passing through said straight end portion of said clip aand said rib and having enlarged end portions, respectively, engaging downwardly facing surfaces of said clip and upwardly facing surfaces of said rib.

6. A gasket structure according to claim 5, wherein said fastener comprises a rivet.

* * * * *